US011358765B2

(12) United States Patent
Shen

(10) Patent No.: US 11,358,765 B2
(45) Date of Patent: Jun. 14, 2022

(54) DOUBLE BUTTON CREAM BOTTLE

(71) Applicant: APR Beauty Group Inc., Toronto (CA)

(72) Inventor: Jun Shen, New Westminster (CA)

(73) Assignee: APR BEAUTY GROUP INC., Toronto (CA)

( * ) Notice: Subject to any disclaimer, the term of this patent is extended or adjusted under 35 U.S.C. 154(b) by 310 days.

(21) Appl. No.: 16/673,450

(22) Filed: Nov. 4, 2019

(65) Prior Publication Data

US 2021/0086965 A1 Mar. 25, 2021

(30) Foreign Application Priority Data

Aug. 23, 2019 (CN) ..... 201921378085.1

(51) Int. Cl.
*B65D 50/04* (2006.01)
*B65D 43/02* (2006.01)
*B65D 55/12* (2006.01)

(52) U.S. Cl.
CPC ..... *B65D 50/048* (2013.01); *B65D 43/0227* (2013.01); *B65D 50/043* (2013.01); *B65D 55/12* (2013.01); *B65D 2251/20* (2013.01)

(58) Field of Classification Search
CPC ..... B65D 50/048; B65D 43/0227; B65D 50/043; B65D 55/12; B65D 2251/20
USPC ..... 220/281; 215/216, 217
See application file for complete search history.

(56) References Cited

U.S. PATENT DOCUMENTS 3,656,646 A * 4/1972 Taylor ..... B65D 50/06 215/206
4,006,836 A * 2/1977 Micallef ..... B65D 50/048 215/218
5,394,999 A * 3/1995 Krall ..... B65D 50/046 215/209

(Continued)

*Primary Examiner* — J. Gregory Pickett
*Assistant Examiner* — Niki M Eloshway

(57) ABSTRACT

Disclose is a double button cream bottle, which comprises a bottle body and a bottle cap for closing the bottle body, wherein an inner ring of the bottle cap is provided with an abutment ring, an upper limit of the abutment ring is provided with a button ring, and the button ring comprises two buttons disposed opposite each other and an elastic ring connecting the two buttons; an upper portion of the bottle body is convexly and radially provided with a flange, a recess is formed at a lower end of the flange, and when the bottle body is inserted into the bottle cap, the elastic ring is snapped in the recess and limits the flange between an inner end of the bottle cap and the elastic ring; an upper end of the bottle body is covered with a cover plate, the cover plate is provided with an elastic piece upwardly tilted, and when it is closed, the elastic piece is limited between the inner end of the bottle cap and the cover plate; a side wall of the bottle cap is provided with button grooves corresponding to the buttons, and when the two buttons are simultaneously pressed, the elastic ring is pressed and deformed and disengages from the recess, so that the flange disengages from the limiting of the elastic ring; and the bottle body is separated from the bottle cap by the elastic force of the elastic piece, and through the above arrangement, the bottle body and the bottle cap can disengage from and be closed to each other without accidental opening.

10 Claims, 7 Drawing Sheets

(56) References Cited

U.S. PATENT DOCUMENTS

| | | | | |
|---|---|---|---|---|
| 5,819,967 | A * | 10/1998 | Lo | B65D 50/062 215/206 |
| 7,118,298 | B2 * | 10/2006 | Tsutsumi | A45D 34/045 401/129 |
| 7,828,166 | B1 * | 11/2010 | Sprick | B65D 50/046 215/209 |
| 8,235,233 | B2 * | 8/2012 | Pehr | B65D 47/0838 215/237 |
| 8,590,719 | B2 * | 11/2013 | Sprishen | B65D 50/041 215/216 |
| 11,140,964 | B2 * | 10/2021 | Shen | A45D 34/045 |
| 2012/0175336 | A1 * | 7/2012 | Miller | B65D 3/18 215/216 |
| 2020/0189803 | A1 * | 6/2020 | Tapocik | B65D 50/046 |

* cited by examiner

DOUBLE BUTTON CREAM BOTTLE

TECHNICAL FIELD

The present invention relates to the technical field of cosmetic packaging containers, and in particular to a double button cream bottle.

BACKGROUND ART

The cream bottle is a box for installing cosmetics such as face cream and paste cream; the existing cream bottle generally comprises an outer bottle body, a detachable inner bottle body, and a bottle cap; and the cream bottle can be used continuously by only replacing the inner bottle body after the cream is used up, i.e. through the replacement of the inner bottle body, reducing material loss and use costs. The current cream bottle utilizes screw connection or single button plug connection, and for the cream bottle utilizing thread engagement connection, since it is cumbersome to close and disengage the bottle cap and the bottle body, it is inconvenient for a consumer to close and open them; for the cream bottle utilizing single button plug connection, the phenomenon of accidental opening during carrying exists, which causes the disengagement of the bottle body or the bottle cap, and the phenomenon that the cream is exposed to the outside to cause the contamination of the cream also exists, which then causes unnecessary waste; and on the one hand, the phenomenon of accidental opening of the cream bottle by children exists, and if the cream bottle is used improperly, there may be serious consequences.

SUMMARY OF THE INVENTION

An object of the present invention is to provide a double button cream bottle with a double button structure, which can conveniently disengage a bottle body from a bottle cap for use or quickly close the bottle body and the bottle cap together for preservation; and the phenomenon of accidental opening does not occur during carrying, which can prevent children from accidentally opening the cream bottle.

The above technical object of the present invention is achieved by the following technical solution: a double button cream bottle comprising a bottle body and a bottle cap for closing the bottle body, wherein an inner ring of the bottle cap is provided with an abutment ring, an upper limit of the abutment ring is provided with a button ring, and the button ring comprises two buttons disposed opposite each other and an elastic ring connecting the two buttons; an upper portion of the bottle body is convexly and radially provided with a flange, a recess is formed at a lower end of the flange, and when the bottle body is inserted into the bottle cap, the elastic ring is snapped in the recess and limits the flange between an inner end of the bottle cap and the elastic ring; an upper end of the bottle body is covered with a cover plate, the cover plate is provided with an elastic piece upwardly tilted, and when it is closed, the elastic piece is limited between the inner end of the bottle cap and the cover plate; a side wall of the bottle cap is provided with button grooves corresponding to the buttons, and when the two buttons are simultaneously pressed, the elastic ring is pressed and deformed and disengages from the recess, so that the flange disengages from the limiting of the elastic ring; and the bottle body is separated from the bottle cap by the elastic force of the elastic piece.

Further, the inner end of the bottle cap is provided with a cover sheet, an upper portion of the flange is provided with a sealing rib, and when the bottle body is inserted into the bottle cap, the sealing rib abuts closely against the cover sheet.

Further, an upper portion of the cover plate is provided with an annular boss, and an inner ring of the flange is provided with a step for supporting the annular boss.

Further, the abutment ring is circumferentially provided with a groove, and the inner ring of the bottle cap is convexly provided with a snap ring that is in snap fit with the groove.

Further, the abutment ring is provided with arcuate grooves at one end of the button grooves, and the buttons at least partially extend into the arcuate grooves.

Further, limiting plates extend upwardly from an inner end of the abutment ring, and the limiting plates are disposed corresponding to the button grooves.

Further, the inner ring of the bottle cap is circumferentially provided with several reinforcing ribs, and upper portions of the reinforcing ribs extend to the inner end of the bottle cap.

In summary, the present invention has the following advantageous effects:

in a double button cream bottle, an upper limit of an abutment ring is provided with a button ring, the button ring comprises two buttons disposed opposite each other and an elastic ring connecting the two buttons, an upper portion of a bottle body is convexly and radially provided with a flange, a recess is formed at a lower end of the flange, and when the bottle body is inserted into a bottle cap, the elastic ring is snapped in the recess and limits the flange between an inner end of the bottle cap and the elastic ring, such that the bottle body and the bottle cap are locked as a whole; the cream bottle utilizes plug installation, so that the bottle body and the bottle cap are closed as a whole quickly, which then brings great convenience to a user; when the two buttons are simultaneously pressed, the elastic ring is pressed and deformed, so that the elastic ring snapped in the recess expands outwardly and disengages from the recess, and then the end of the bottle body that is inserted into the bottle cap disengages from the limiting of the elastic ring; and the bottle body is separated from the bottle cap by the elastic force of an elastic piece, and through the structure in which the bottle body is separated from the bottle cap via the double buttons, the cream bottle completely eliminates the phenomenon that a single button is accidentally opened during carrying, thereby avoiding unnecessary waste, and on the other hand, children are prevented from accidentally opening the cream bottle, thereby achieving stronger user experience.

In the figures: 1. Bottle body; 11. Flange; 12. Recess; 13. Sealing rib; 14. Step; 2. Bottle cap; 21. Button groove; 22. Cover sheet; 23. Snap ring; 24. Reinforcing rib; 25. Annular rib; 3. Abutment ring; 31. Groove; 32. Arcuate groove; 33. Limiting plate; 4. Button ring; 41. Button; 42. Elastic ring; 5. Cover plate; 51. Elastic piece; 52. Annular boss.

DETAILED DESCRIPTION OF EMBODIMENTS

The present invention will be further described below in conjunction with the accompanying drawings.

Figure 1:
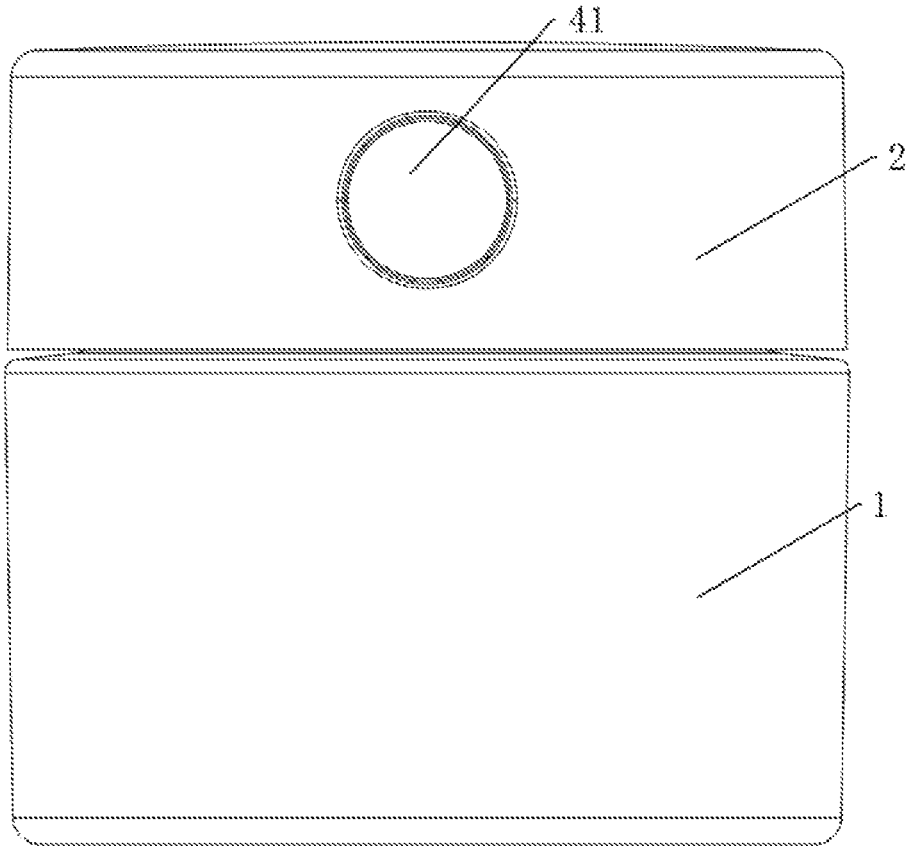
FIG. 1 is a schematic front view of the present invention.
Figure 2:
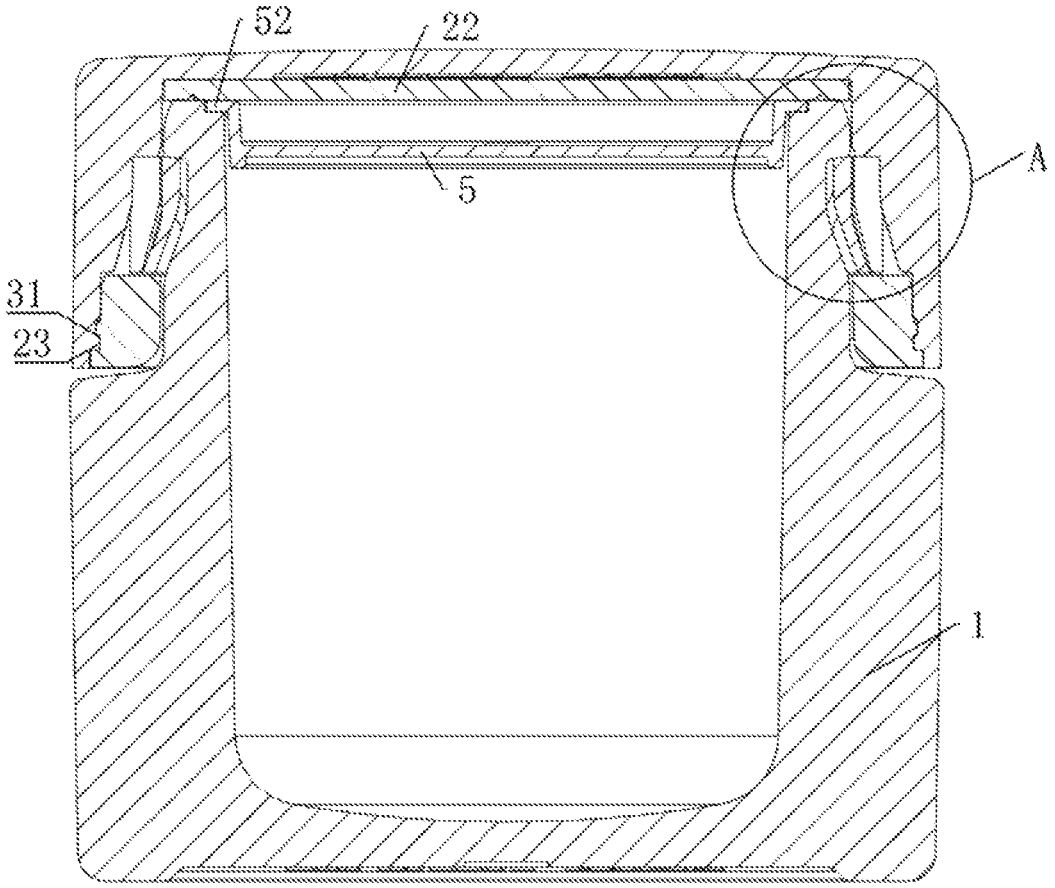
FIG. 2 is a cross-sectional view of the present invention from a first perspective.
Figure 3:
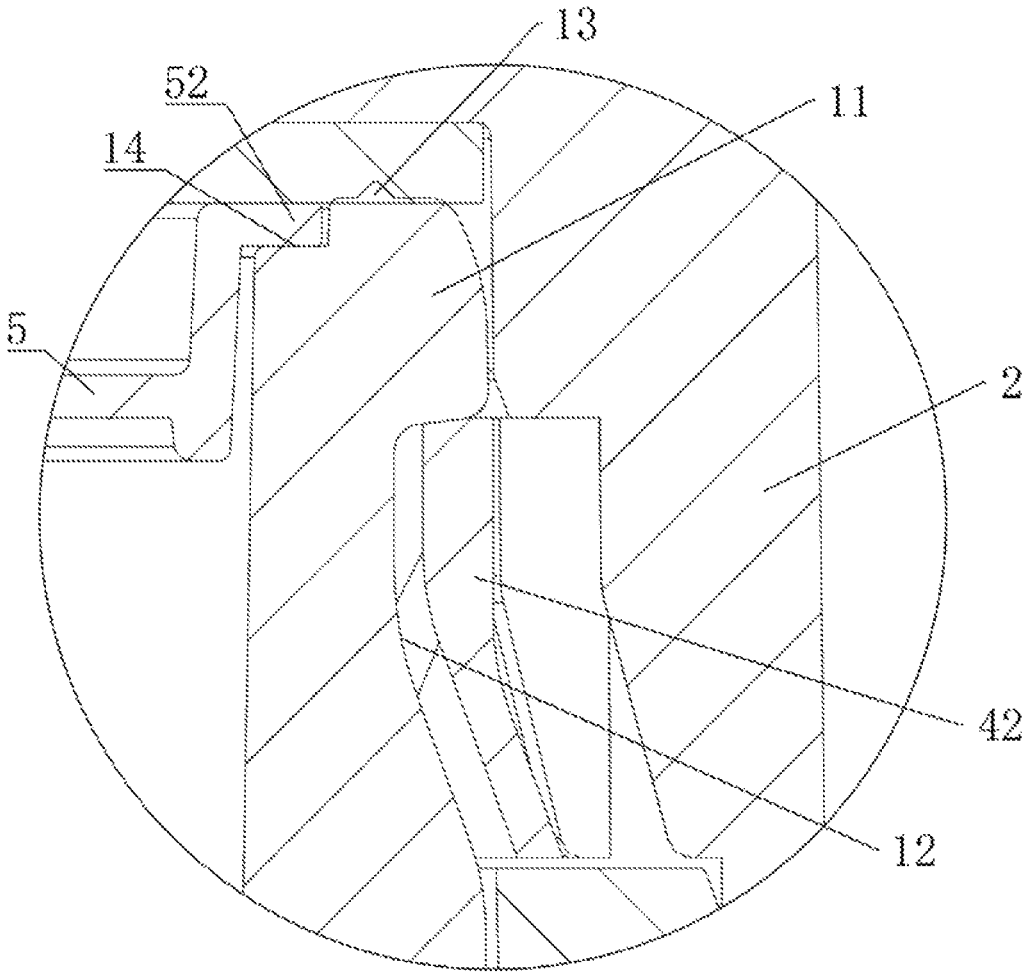
FIG. 3 is an enlarged view of a section A of the present invention.
Figure 4:
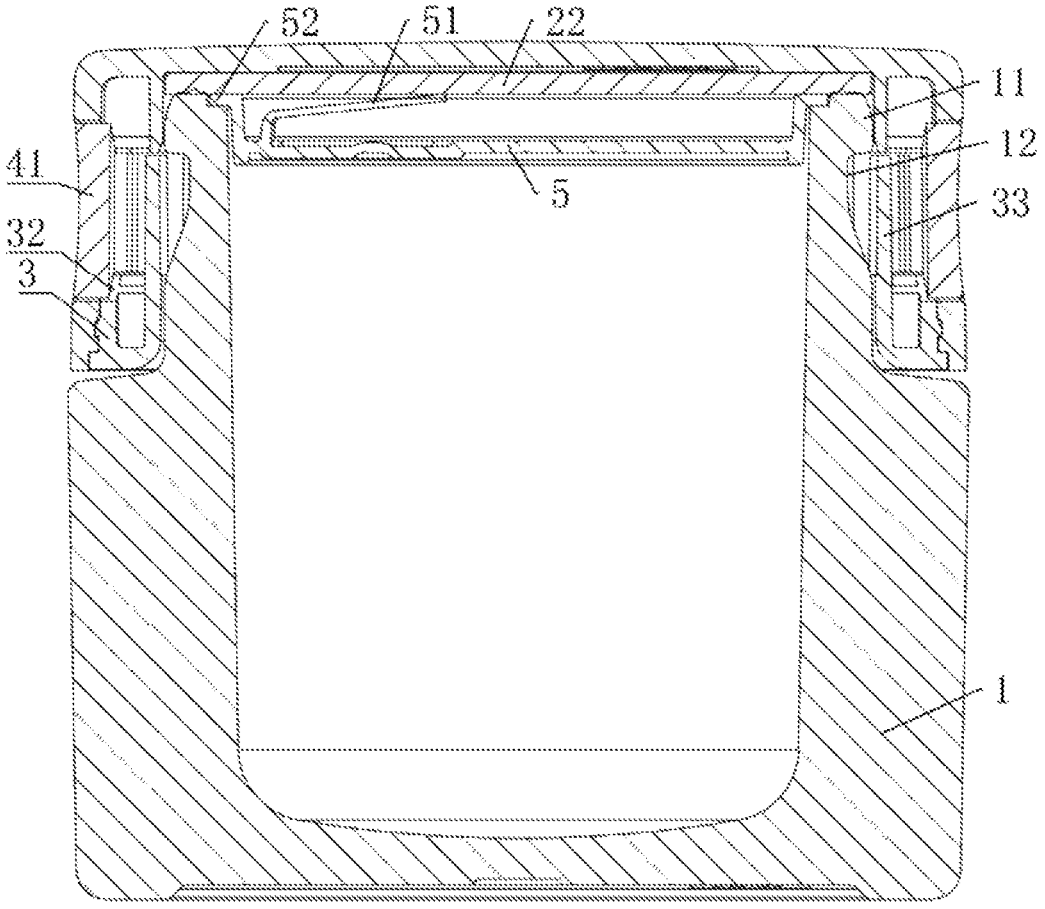
FIG. 4 is a cross-sectional view of the present invention from a second perspective.
Figure 5:
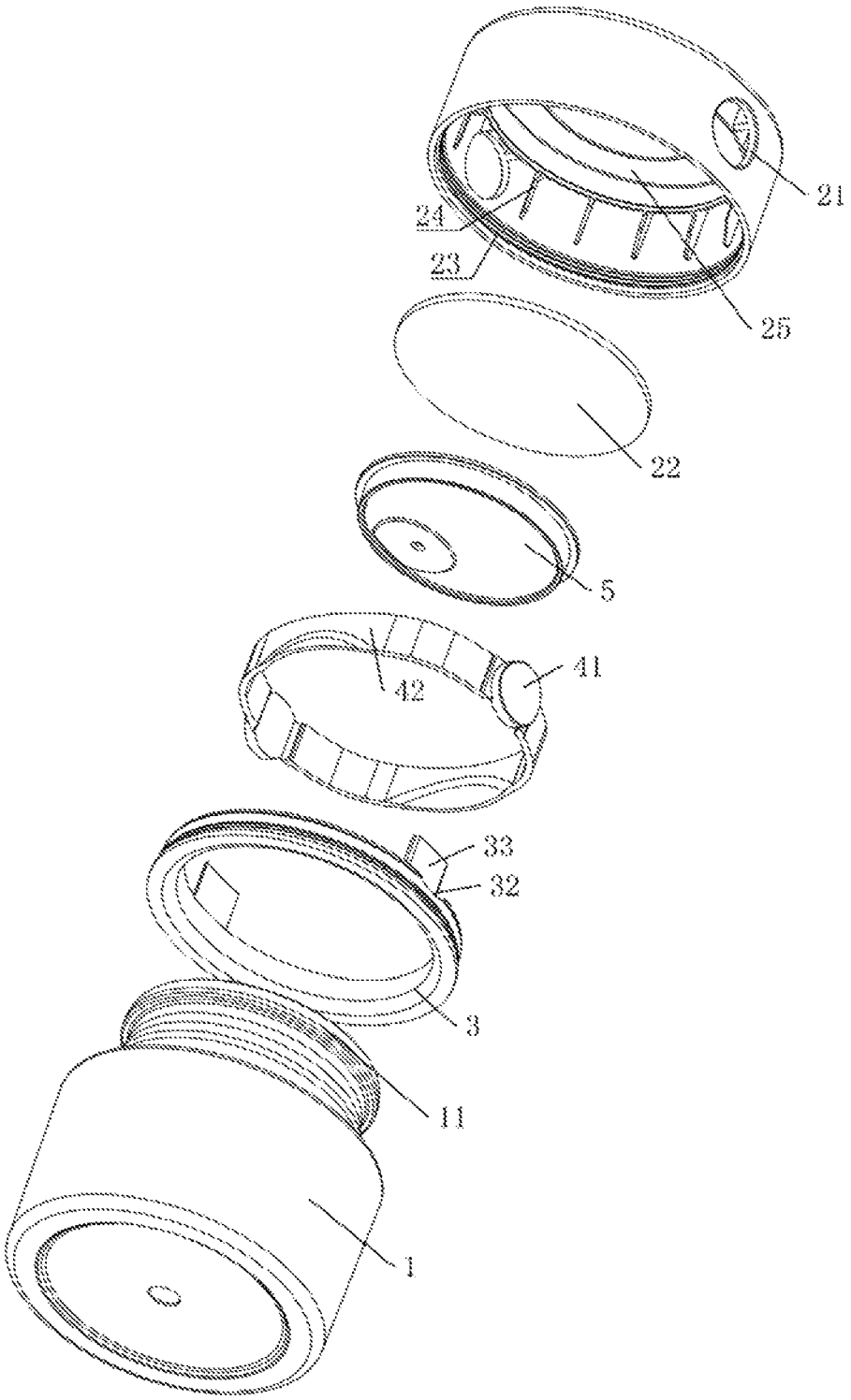
FIG. 5 is an exploded view of the present invention.
Figure 6:
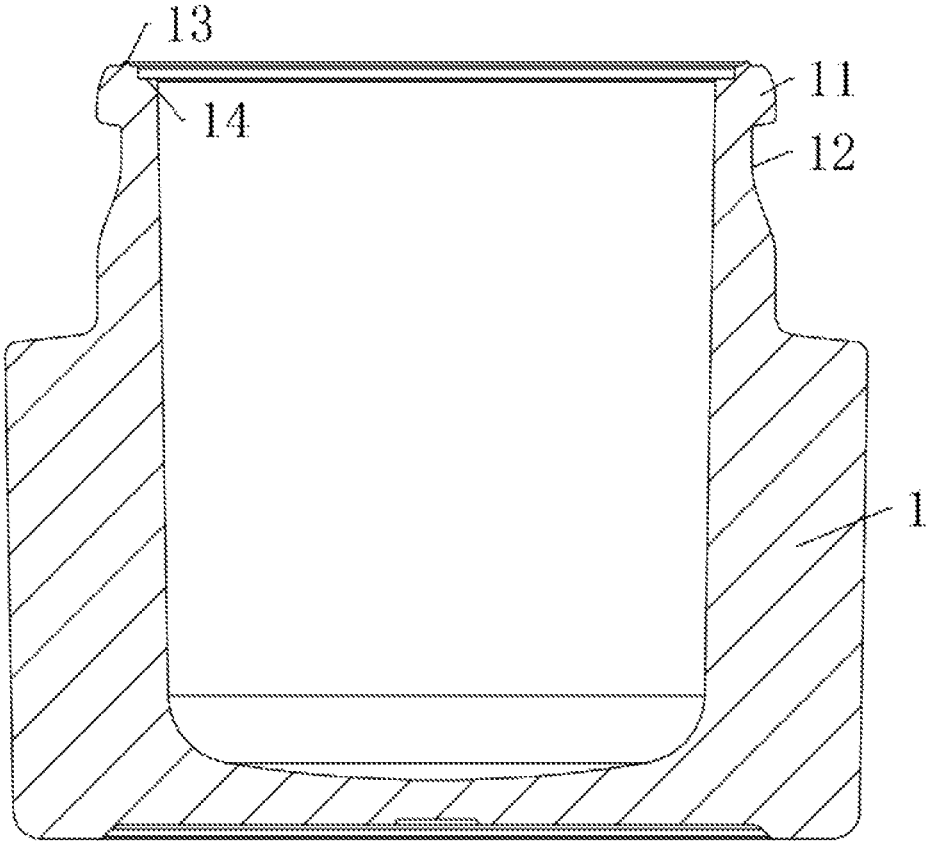
FIG. 6 is a cross-sectional view of a bottle body of the present invention.
Figure 7:
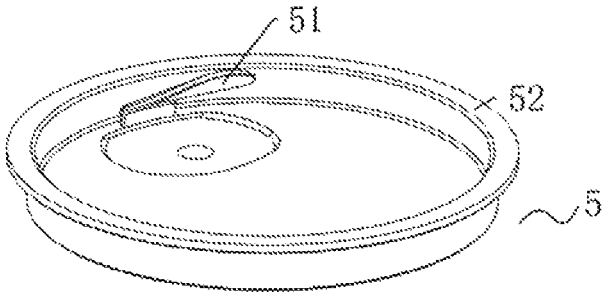
FIG. 7 is a schematic structural view of a cover plate of the present invention.
Figure 8:
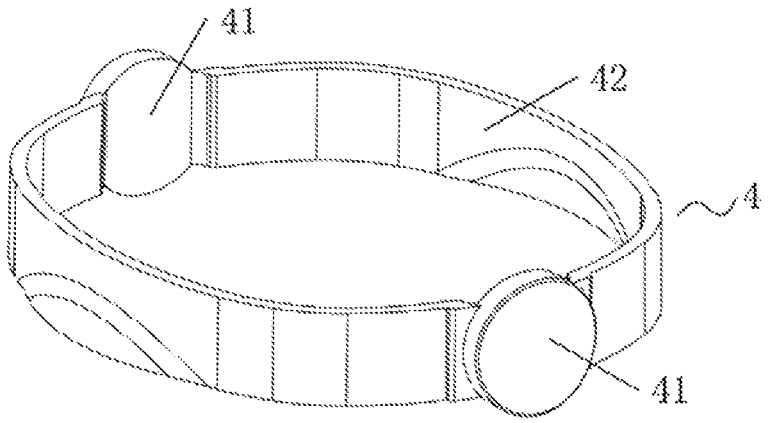
FIG. 8 is a schematic structural view of a button ring of the present invention.
Figure 9:
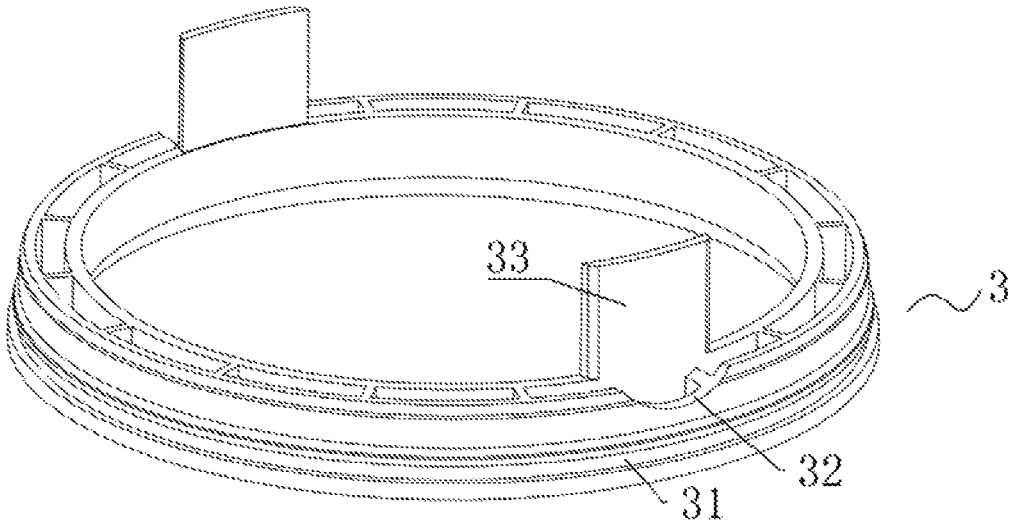
FIG. 9 is a schematic structural view of an abutment ring of the present invention.

As shown in FIGS. 1-9, a double button cream bottle comprises a bottle body 1 and a bottle cap 2 for closing the bottle body 1, and the bottom of the bottle body 1 is provided with an empty groove recessed 12 inwardly, which can increase the stability of the cream bottle when placed vertically.

An inner ring of the bottle cap 2 is provided with an abutment ring 3, the abutment ring 3 is circumferentially provided with a groove 31, and the inner ring of the bottle cap 2 is convexly provided with a snap ring 23 in snap fit with the groove 31; the abutment ring 3 is integrally connected with the bottle cap 2 through the snap fit of the snap ring 23 and the groove 31, a lower end of the abutment ring 3 is located inside the bottle cap 2, and a lower end of an inner ring of the abutment ring 3 is provided with a rounded corner to facilitate the insertion of a flange 11 into the bottle cap 2.

An upper limit of the abutment ring 3 is provided with a button ring 4, and the button ring 4 comprises two buttons 41 disposed opposite each other and an elastic ring 42 connecting the two buttons 41; and the elastic ring 42 is of an elliptical structure in a normal state, and when the buttons 41 on both sides are pressed, the elastic ring 42 is deformed under pressure and expands outward.

An upper portion of the bottle body 1 is convexly and radially provided with a flange 11, a recess 12 is formed at a lower end of the flange 11, and when the bottle body 1 is inserted into the bottle cap 2, the elastic ring 42 is snapped in the recess 12 and limits the flange 11 between an inner end of the bottle cap 2 and the elastic ring 42; and the bottle body 1 and the bottle cap 2 are locked as a whole by the above-mentioned plug connection, so that the bottle cap 2 and the bottle body are closed conveniently, which can bring great convenience to a user.

An upper end of the bottle body 1 is covered with a cover plate 5, the cover plate 5 is provided with an elastic piece 51 upwardly tilted, and when it is closed, the elastic piece 51 is limited between the inner end of the bottle cap 2 and the cover plate 5; an upper portion of the cover plate 5 is provided with an annular boss 52, and an inner ring of the flange 11 is provided with a step 14 for supporting the annular boss 52; and when the buttons 41 on both sides are simultaneously pressed, the cover plate 5 along with the bottle body 1 is separated from the bottle cap 2.

A side wall of the bottle cap 2 is provided with button grooves 21 corresponding to the buttons 41, and when the two buttons 41 are simultaneously pressed, the elastic ring 42 is pressed and deformed, so that the elastic ring 42 snapped in the recess 12 expands outwardly and disengages from the recess 12, and then the end of the bottle body 1 that is inserted into the bottle cap 2 disengages from the limiting of the elastic ring 42; and the bottle body 1 is separated from the bottle cap 2 by the elastic force of the elastic piece 51, and through the structure in which the bottle body 1 is separated from the bottle cap 2 via the double buttons 41, the cream bottle completely eliminates the phenomenon that a single button 41 is accidentally opened during carrying, thereby avoiding unnecessary waste, and thus achieving stronger user experience.

The inner end of the bottle cap 2 is provided with a cover sheet 22, and the cover sheet 22 is glued integrally with the inner end of the bottle cap 2; when inserted into the bottle cap 2, the sealing rib 13 closely abuts against the cover sheet 22; and through the above arrangement, it is convenient to seal the cream in the bottle body 1 and beneficial to the preservation of the cream.

The abutment ring 3 is provided with arcuate grooves 32 at one end of the button grooves 21, the buttons 41 extend at least partially into the arcuate grooves 32, and the arcuate groove 32 circumferentially limits the button 41 at the corresponding end; when the buttons 41 on both sides are pressed, the buttons 41 can only move radially in the arcuate grooves 32; and by adding the arcuate grooves 32, the phenomenon of circumferential rotation of the buttons 41 when pressed is avoided.

Limiting plates 33 extend upwardly from an inner end of the abutment ring 3, the limiting plates 33 are disposed corresponding to the button grooves 21, and the limiting plates 33 are disposed for radial limitation to the degree to which the buttons 41 are pressed, thus preventing the buttons 41 from being pressed excessively and disengaging from the arcuate grooves 32.

An annular rib 25 extends downwardly from the inner end of the bottle cap 2, and the cover sheet 22 is located within the annular rib 25; the inner ring of the bottle cap 2 is circumferentially provided with several reinforcing ribs 24, and upper portions of the reinforcing ribs 24 extend to the inner end of the bottle cap 2 and the annular rib 25; and the strength of the bottle cap 2 can be increased by adding the reinforcing ribs 24.

The basic working principle of the present invention is:

in a double button cream bottle, an upper limit of an abutment ring 3 is provided with a button ring 4, the button ring 4 comprises two buttons 41 disposed opposite each other and an elastic ring 42 connecting the two buttons 41, an upper portion of a bottle body 1 is convexly and radially provided with a flange 11, a recess 12 is formed at a lower end of the flange 11, and when the bottle body 1 is inserted into a bottle cap 2, the elastic ring 42 is snapped in the recess 12 and limits the flange 11 between an inner end of the bottle cap 2 and the elastic ring 42, such that the bottle body 1 and the bottle cap 2 are locked as a whole; the cream bottle utilizes plug installation, so that the bottle body 1 and the bottle cap 2 are closed as a whole quickly, which then brings great convenience to a user; when the two buttons 41 are simultaneously pressed, the elastic ring 42 is pressed and deformed, so that the elastic ring 42 snapped in the recess 12 expands outwardly and disengages from the recess 12, and then the end of the bottle body 1 that is inserted into the bottle cap 2 disengages from the limiting of the elastic ring 42; and the bottle body 1 is separated from the bottle cap 2 by the elastic force of an elastic piece 51, and through the structure in which the bottle body 1 is separated from the bottle cap 2 via the double buttons 41, the cream bottle completely eliminates the phenomenon that a single button 41 is accidentally opened during carrying, thereby avoiding unnecessary waste, and on the other hand, children are prevented from accidentally opening the cream bottle, thereby achieving stronger user experience.

The above description is merely a preferred embodiment of the present invention, and all equivalent variations or modifications made to the structures, features and principles described in the scope of the present invention fall into the scope of the present invention.

What is claimed is:

1. A double button cream bottle comprising a bottle body (1) and a bottle cap (2) for closing the bottle body (1), wherein: an inner ring of the bottle cap (2) is provided with an abutment ring (3), an upper limit of the abutment ring (3) is provided with a button ring (4), and the button ring (4) comprises two buttons (41) disposed opposite each other and an elastic ring (42) connecting the two buttons (41); an upper portion of the bottle body (1) is convexly and radially provided with a flange (11), a recess (12) is formed at a lower end of the flange (11), and when the bottle body (1) is inserted into the bottle cap (2), the elastic ring (42) is snapped in the recess (12) and limits the flange (11) between an inner end of the bottle cap (2) and the elastic ring (42); an upper end of the bottle body (1) is covered with a cover plate (5), the cover plate (5) has formed integrally thereon an elastic piece (51) upwardly tilted, and when the bottle body is closed by the bottle cap, the elastic piece (51) is limited between the inner end of the bottle cap (2) and the cover plate (5); a side wall of the bottle cap (2) is provided with button grooves (21) corresponding to the buttons (41), and when the two buttons (41) are simultaneously pressed, the elastic ring (42) is pressed and deformed and disengages from the recess (12), so that the flange (11) disengages from the elastic ring (42) and an elastic force of the elastic piece (51) separates the cover plate and the bottle body from the bottle cap.

2. The double button cream bottle according to claim 1, wherein: the inner end of the bottle cap (2) is provided with a cover sheet (22), an upper portion of the flange (11) is provided with a sealing rib (13), and when the bottle body (1) is inserted into the bottle cap (2), the sealing rib (13) abuts closely against the cover sheet (22).

3. The double button cream bottle according to claim 1, wherein: an upper portion of the cover plate (5) is provided with an annular boss (52), and an inner ring of the flange (11) is provided with a step (14) for supporting the annular boss (52).

4. The double button cream bottle according to claim 1, wherein: the abutment ring (3) is circumferentially provided with a groove (31), and the inner ring of the bottle cap (2) is convexly provided with a snap ring (23) that is in snap fit with the groove (31).

5. The double button cream bottle according to claim 1, wherein: the abutment ring (3) is provided with arcuate grooves (32) at one end of the button grooves (21), and the buttons (41) at least partially extend into the arcuate grooves (32).

6. A double button cream bottle comprising a bottle body (1) and a bottle cap (2) for closing the bottle body (1), wherein: an inner ring of the bottle cap (2) is provided with an abutment ring (3), an upper limit of the abutment ring (3) is provided with a button ring (4), and the button ring (4) comprises two buttons (41) disposed opposite each other and an elastic ring (42) connecting the two buttons (41); an upper portion of the bottle body (1) is convexly and radially provided with a flange (11), a recess (12) is formed at a lower end of the flange (11), and when the bottle body (1) is inserted into the bottle cap (2), the elastic ring (42) is snapped in the recess (12) and limits the flange (11) between an inner end of the bottle cap (2) and the elastic ring (42); an upper end of the bottle body (1) is covered with a cover plate (5), the cover plate (5) is provided with an elastic piece (51) upwardly tilted, and when it is closed, the elastic piece (51) is limited between the inner end of the bottle cap (2) and the cover plate (5); a side wall of the bottle cap (2) is provided with button grooves (21) corresponding to the buttons (41), and when the two buttons (41) are simultaneously pressed, the elastic ring (42) is pressed and deformed and disengages from the recess (12), so that the flange (11) disengages from the limiting of the elastic ring (42); the bottle body (1) is separated from the bottle cap (2) by the elastic force of the elastic piece (51); and wherein limiting plates (33) extend upwardly from an inner end of the abutment ring (3), and the limiting plates (33) are disposed corresponding to the button grooves (21).

7. The double button cream bottle according to claim 6, wherein: the inner ring of the bottle cap (2) is circumferentially provided with several reinforcing ribs (24), and upper portions of the reinforcing ribs (24) extend to the inner end of the bottle cap (2).

8. The double button cream bottle according to claim 6, wherein: an upper portion of the cover plate (5) is provided with an annular boss (52), and an inner ring of the flange (11) is provided with a step (14) for supporting the annular boss (52).

9. The double button cream bottle according to claim 6, wherein: the abutment ring (3) is circumferentially provided with a groove (31), and the inner ring of the bottle cap (2) is convexly provided with a snap ring (23) that is in snap fit with the groove (31).

10. The double button cream bottle according to claim 6, wherein: the abutment ring (3) is provided with arcuate grooves (32) at one end of the button grooves (21), and the buttons (41) at least partially extend into the arcuate grooves (32).

* * * * *